US010281089B2

(12) United States Patent
Fang et al.

(10) Patent No.: US 10,281,089 B2
(45) Date of Patent: May 7, 2019

(54) FIXING DEVICE AND LED BULB

(71) Applicant: NINGBO YAMAO OPTOELECTRONICS CO., LTD., Ningbo, Zhejiang (CN)

(72) Inventors: Hu Fang, Zhejiang (CN); Qili Xu, Zhejiang (CN); Yinyong Zhou, Zhejiang (CN)

(73) Assignee: NINGBO YAMAO OPTOELECTRONICS CO., LTD., Ningbo, Zhejiang (CN)

( * ) Notice: Subject to any disclaimer, the term of this patent is extended or adjusted under 35 U.S.C. 154(b) by 0 days.

(21) Appl. No.: 15/699,003

(22) Filed: Sep. 8, 2017

(65) Prior Publication Data

US 2018/0274733 A1 Sep. 27, 2018

(30) Foreign Application Priority Data

Mar. 21, 2017 (CN) ..... 2017 1 0170656
Jun. 5, 2017 (CN) ..... 2017 1 0413146
Jun. 5, 2017 (CN) ..... 2017 2 0643670 U

(51) Int. Cl.

| | |
|---|---|
| ***F21V 21/00*** | (2006.01) |
| ***F21K 9/235*** | (2016.01) |
| ***F21K 9/237*** | (2016.01) |
| ***F21K 9/275*** | (2016.01) |
| ***F21K 9/23*** | (2016.01) |
| ***F21K 9/232*** | (2016.01) |
| ***F21V 19/00*** | (2006.01) |
| ***F21V 23/02*** | (2006.01) |
| ***F21V 29/70*** | (2015.01) |
| ***F21K 9/20*** | (2016.01) |
| *F21V 3/00* | (2015.01) |
| *F21Y 115/10* | (2016.01) |

(52) U.S. Cl.

CPC ..... *F21K 9/235* (2016.08); *F21K 9/20* (2016.08); *F21K 9/23* (2016.08); *F21K 9/232* (2016.08); *F21K 9/237* (2016.08); *F21K 9/275* (2016.08); *F21V 19/006* (2013.01); *F21V 23/02* (2013.01); *F21V 29/70* (2015.01); *F21V 3/00* (2013.01); *F21Y 2115/10* (2016.08)

(58) Field of Classification Search

CPC ..... F21K 9/235; F21K 9/23238; F21K 9/23–9/238

See application file for complete search history.

(56) References Cited

U.S. PATENT DOCUMENTS

2014/0126202 A1* 5/2014 Kachala ..... F21V 3/061 362/235

* cited by examiner

*Primary Examiner* — Sean P Gramling
(74) *Attorney, Agent, or Firm* — Yue (Robert) Xu; Apex Attorneys at Law, LLP

(57) ABSTRACT

A fixing device includes a structural member and a fixing ring. The structural member is a cylindrical structure having a first screw thread on its outer peripheral surface and the first screw thread matches with an LED lamp fixture. The structural member is opened at the top, and a through hole, a threaded hole, and a guide post are provided at the bottom of the structural member. An inner wall of the fixing ring is provided with a second screw thread matching with the first screw thread, and the structural member can be fixed into the LED lamp fixture by rotating the fixing ring.

13 Claims, 3 Drawing Sheets

FIXING DEVICE AND LED BULB

CROSS-REFERENCE TO RELATED APPLICATIONS

This application claims the benefit of priorities to Chinese Patent Application No. 201710170656.1 titled "LED BULB FOR REPLACING INDOOR WALL LAMP", filed with the Chinese State Intellectual Property Office on Mar. 21, 2017, Chinese Patent Application No. 201710413146.2 titled "FIXING DEVICE AND LED BULB", filed with the Chinese State Intellectual Property Office on Jun. 5, 2017, and Chinese Patent Application No. 201720643670.4 titled "FIXING DEVICE AND LED BULB", filed with the Chinese State Intellectual Property Office on Jun. 5, 2017, the entire disclosures of which are incorporated herein by reference.

FIELD

The present application relates to the field of light emitting diode (LED) bulbs, and more particularly to a fixing device and an LED bulb.

BACKGROUND

LED light sources have become the first choice for consumers due to their small size, low power consumption and other advantages, and create clean and bright indoor environments for us.

In the conventional technology, LED lamp fixtures mainly have two design manners. In one manner, an LED lamp socket matching with an LED bulb is provided inside an LED lamp fixture and is used for fixing the LED bulb, and since the lamp sockets have various specifications and types, such as different models including E27, E26, E14, E12, G12, in this design manner, these lamp sockets are not universal, thus is inconvenient to replace. In another manner, a lamp fixture, a power supply and a light source are designed integrally by the patch processing, and in this case, if any part of the LED lamp fixture is damaged, this part cannot be replaced separately, which results in waste of resources, and causes pressures to environmental protection.

Therefore, an issue to be addressed urgently currently is to enable LED bulbs to be universal, to reduce the waste of resources.

SUMMARY

In view of this, an object of the present application is to provide a fixing device, which can allow an LED lamp fixture to be universal, to reduce the waste of resources and address the issue in the field currently. Another object of the present application is to provide an LED bulb including the above-described fixing device, and therefore, the LED bulb is universal and the waste of resources is reduced.

A fixing device, includes:

a structural member, wherein the structural member is a cylindrical structure, a first screw thread is provided on an outer peripheral surface of the cylindrical structure and the first screw thread is configured to match with an LED lamp fixture, a top of the structural member is open, and a through hole configured to allow a wire to pass through, and a threaded hole and a guide post configured to install a heat dissipation member are provided at a bottom of the structural member; and a fixing ring, wherein the fixing ring is a ring-shaped structure, and an inner wall of the ring-shaped structure is provided with a second screw thread matching with the first screw thread, and the fixing ring is configured to be rotated to fix the structural member into the LED lamp fixture.

Preferably, the fixing device further includes a heat dissipation member. The heat dissipation member is fixed inside the structural member, and is a cylindrical structure matching with an inner wall of the structural member, and is fixed to the structural member by a fastener.

Preferably, in the fixing device, the bottom of the structural member is provided with a threaded hole configured to fix the heat dissipation member, and a fastener for fixing the structural member and the heat dissipation member is inserted in the threaded hole.

Preferably, the fixing device further includes a fixing plate. The fixing plate matches with the bottom of the structural member, and is fixed to an outside of the structural member, and the fastener passes through the fixing plate, the structural member and the heat dissipation member in the listed sequence.

Preferably, in the fixing device, two of the threaded holes are provided at the bottom of the structural member, and two of the fasteners are inserted in the two threaded holes respectively.

Preferably, in the fixing device, the fastener is a screw.

Preferably, in the fixing device, the through hole is provided at a central position of the bottom of the structural member.

Preferably, in the fixing device, the two threaded holes are arranged symmetrically at two sides of the through hole.

Preferably, in the fixing device, a material for making the structural member is plastic or ceramic.

Preferably, in the fixing device, a material for making the heat dissipation member is metal.

An LED bulb includes the fixing device according to any one of the above solutions.

Preferably, the LED bulb further includes:

a heat conduction member fixed inside the heat dissipation member;

a power supply arranged between the heat conduction member and the heat dissipation member;

a light source plate fixed at a top of the heat conduction member; and a light source fixed at a top of the light source plate.

Preferably, the LED bulb further includes a housing. The housing is connected to the top of the structural member in a sealed manner.

Preferably, in the LED bulb, the heat conduction member and the heat dissipation member are in an interference fit.

Preferably, in the LED bulb, the housing and the structural member are sealed by adhesive bonding or mechanical connection.

Preferably, in the LED bulb, a material for making the housing is a light-transmitting plastic or a light-transmitting glass.

The fixing device according to the present application includes a structural member and a fixing ring. The structural member is a cylindrical structure having a first screw thread provided on its outer peripheral surface and the first screw threads matches with an LED lamp fixture, the structural member is opened at the top, and a through hole, a threaded hole, and a guide post are provided at the bottom of the structural member. The fixing ring has an inner wall provided with a second screw thread matching with the first screw thread, and the structural member can be fixed into the LED lamp fixture by rotating the fixing ring. In using the fixing device, it simply requires to rotate the structural member into a connecter of the LED lamp fixture and to lock the structural member to the LED lamp fixture by rotating the fixing ring, and the installation of the LED bulb may just be finished without requiring a specialized lamp socket. The fixing device according to the present application can simply and conveniently realize mounting and fixing of any LED bulb in the LED lamp fixture, which allows the LED bulb to have universality and reduces the waste of the resources, and addresses the issue of the field currently.

BRIEF DESCRIPTION OF THE DRAWINGS

For more clearly illustrating embodiments of the present application or technical solutions in the conventional technology, drawings used in the description of the embodiments or the conventional technology will be briefly described hereinafter. Apparently, the drawings in the following description are merely some embodiments of the present application, and fix the person skilled in the art, other drawings may be obtained based on these drawings, without making any creative efforts.

Figure 1:
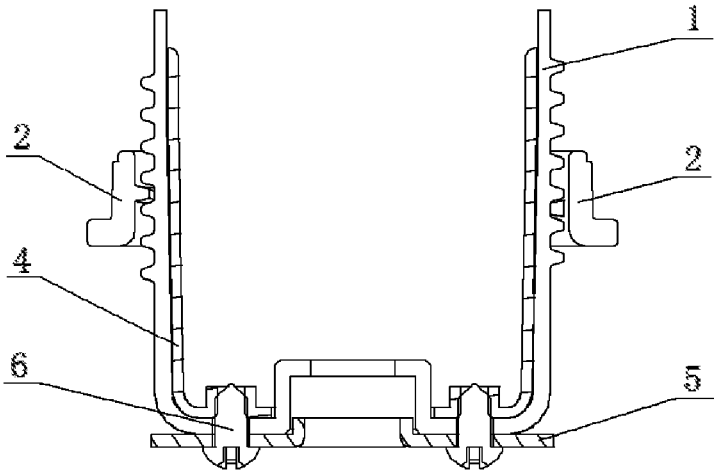
FIG. 1 is a schematic view showing a fixing device according to an embodiment of the present application.

Reference Numerals in FIGS. 1 to 5:

| | | |
|---|---|---|
| 1 structural member, | 2 fixing ring, | 3 wire, |
| 4 heat dissipation member, | 5 fixing plate, | 6 screw, |
| 7 heat conduction member, | 8 power supply, | 9 light source plate, |
| 10 housing, | 11 threaded hole, | 12 guide post, |
| 13 through hole. | | |

DETAILED DESCRIPTION

A fixing device is provided according to an embodiment of the present application, which allows an LED bulb to be universal, to reduce the waste of resources and address the issue in the field currently.

Hereinafter, embodiments of the present application will be described in conjunction with drawings. The following described embodiments do not constitute any limitations to the contents recited by the claims. In addition, the entire content constituted by the following embodiments are not limited to those necessary to the technical solution of the present application recited by the claims.

Figure 2:
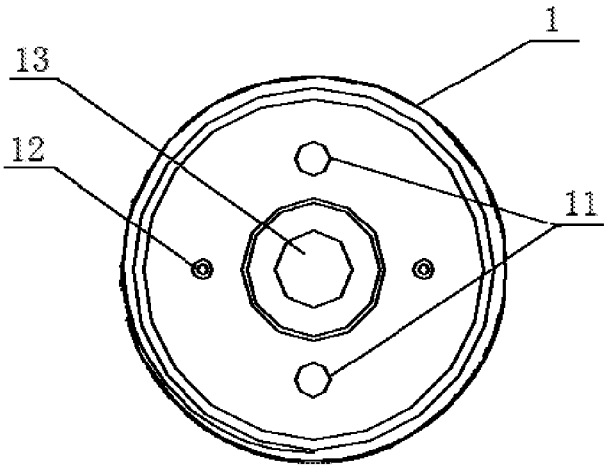
FIG. 2 is a schematic view showing the cross section of a structural member according to an embodiment of the present application.
Figure 3:
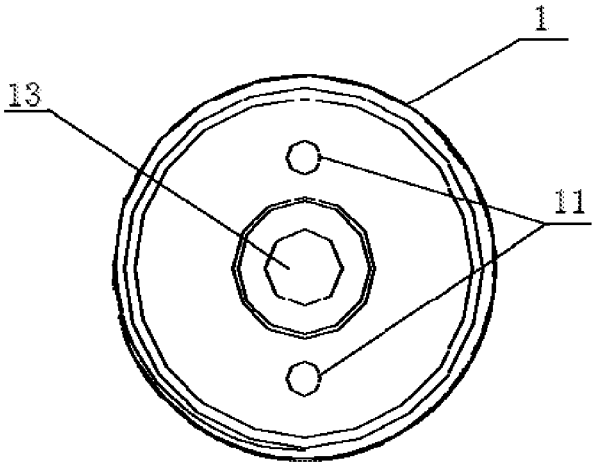
FIG. 3 is a schematic view showing the bottom of the structural member according to an embodiment of the present application.

The fixing device according to this embodiment mainly includes a structural member 1 and a fixing ring 2. The structural member 1 is a cylindrical structure having a first screw thread on its outer peripheral surface, and the first screw thread matches with an LED lamp fixture. The structural member 1 is opened at the top, and has a through hole 13, a threaded hole 11, and a guide post 12 at the bottom. The through hole 13 is configured to allow a wire 3 to pass through, the threaded hole 11 is configured to fix a heat dissipation member, and the guide post 12 is configured to assist in assembling the heat dissipation member. The fixing ring 2 has a ring-shaped structure, and its inner wall is provided with a second screw thread which matches with the first screw thread. In use, the fixing ring 2 is sleeved on the outer peripheral surface of the structural member the structural member 1 is screwed into a connector of the LED lamp fixture, and then the fixing ring 2 is rotated to allow the first screw thread to engage with the second screw thread, to fix the structural member 1 in the LED lamp fixture. The fixing device can install the LED bulb in the LED lamp fixture without requiring a specialized lamp socket, and is adapted to various lamp fixtures such as E27, E26, E14, E12 and G12. Reference may be made to FIGS. 1 to 3 for details.

it is to be noted that, regarding the bottom and top mentioned in this embodiment, an end of the LED bulb that is fixed to the LED lamp fixture is the bottom, and another end of the LED bulb is the top.

In using the fixing device according to this embodiment, it simply requires to rotate the structural member 1 into the connector in the LED lamp fixture and lock the structural member 1 to the LED lamp fixture by rotating the fixing ring 2, and the installation of the LED bulb may just be realized. The fixing device according to the present application can simply and conveniently realize mounting and fixing of any LED bulb in the LED lamp fixture without requiring a specialized lamp socket, which allows the LED bulb to have universality and reduces the waste of the resources, and addresses the issue of the field currently.

The fixing device according to this embodiment may further include a heat dissipation member 4. The heat dissipation member 4 has a cylindrical structure and is fixed inside the structural member 1 and has an outer shape matching an inner wall of the structural member 1. This arrangement facilitates the assembly of the LED bulb, and the heat dissipation member 4 is fixed directly to the structural member 1 to act as a part of the fixing device, thereby omitting the step of installing the heat dissipation member 4 during the assembly. Reference may be made to FIG. 1 for details.

In the fixing device according to this embodiment, in order to further strengthen the fixation of the heat dissipation member 4 to the structural member 1, a threaded hole 11 may be provided at the bottom of the structural member 1, that is, the heat dissipation member 4 is fixed to the structural member 1 by a fastener. Of course, in a particular design, the fixation of the heat dissipation member 4 to the structural member 1 may also be achieved by an interference fit, a snap-fit, or other fixing means having the same effects.

In a practical design, the fixing device according to this embodiment may further include a fixing plate 5 for protecting the structural member 1 to a certain degree when the fastener is fastened, to avoid abrasions caused by direct contact between the fastener and the structural member 1. The fixing plate 5 matches with the bottom of the structural member 1, and is fixed to the outside of the bottom of the structural member 1, that is, the fastener passes through the fixing plate 5, the structural member 1, and the heat dissipation member 4 in the listed sequence, to fix the three members together.

In order to increase the steadiness between the structural member 1 and the heat dissipation member 4, two threaded holes 11 may be provided at the bottom of the structural member 1, and two fasteners pass through the two threaded holes 11 respectively, to fix the heat dissipation member 4 to the structural member 1. The fastener can be a screw 6, a bolt, a stud and etc., and since the fixing device is mainly used in the LED bulb, it is preferable to choose a small-sized screw 6 as the fastener.

In using the fixing device according to this embodiment, other members for providing conditions for the normal operation of the LED bulb, such as the power supply 8, may be arranged inside the cylindrical structure of the structural member 1. For facilitating leading out the wire 3, the through hole 13 may be provided at the center of the bottom of the structural member 1. Moreover, in order to further enhance the stability between the structural member 1 and the heat dissipation member 4, the two threaded holes 11 may be arranged symmetrically at two sides of the through hole 13. Reference may be made to FIGS. 1 to 5 for details.

In the fixing device according to this embodiment, the material of the structural member 1 may employ plastic or ceramic, to further reduce the cost of the fixing device. Metal materials may be used for producing the heat dissipation member 4. Due to factors such as physical properties of aluminum, aluminum can be used as the material for producing the heat dissipation member 4, and the cost of aluminum is low, thus further improving the economy of the fixing device.

An LED bulb is further provided according to this embodiment, which includes the above-described fixing device, and therefore, the LED bulb is universal, which reduces the waste of resources, and improves the economy while reducing the pressure on the environment.

Figure 4:
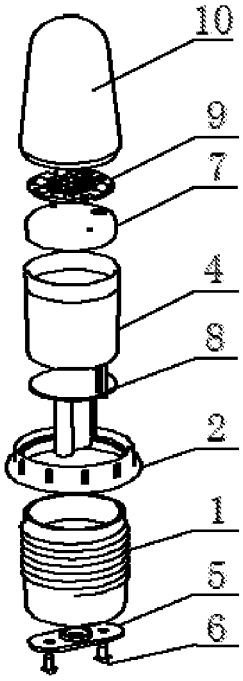
FIG. 4 is an exploded view of an LED bulb according to an embodiment of the present application.
Figure 5:
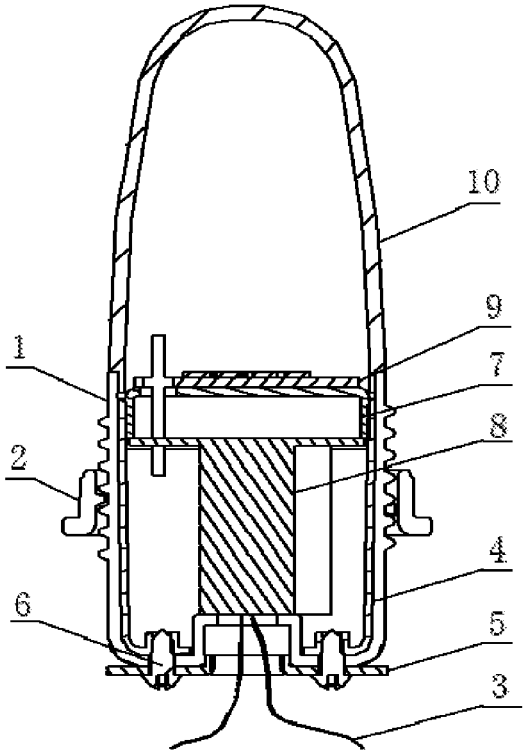
FIG. 5 is a schematic view of an LED bulb according to an embodiment of the present application.

The LED bulb according to this embodiment further includes a heat conduction member 7, a power supply 8, a light source plate 9, and a light source which are all arranged inside the cylindrical structure of the structural member 1. As shown in FIG. 5, the heat conduction member 7 is fixedly arranged inside the heat dissipation member 4; the power supply 8 is arranged between the heat conduction member 7 and the heat dissipation member 4; the light source plate 9 is fixed at the top of the heat conduction member 7, and the light source is fixedly attached to the top of the light source plate 9. Reference may be made to FIGS. 4 and 5 for details.

The LED bulb according to this embodiment further includes a housing 10. The housing 10 is connected to the top of the structural member 1 in a sealed manner and can be fixed to the structural member 1 by adhesive bonding, or by other connection manners having equivalent effects, such as threaded connection, interference fit and other mechanical connection manners. The material for making the housing 10 may be a light-transmitting plastic or a light-transmitting glass. In a practical design, different lighting effects may be exhibited by different materials of the housing 10.

The description of the embodiments disclosed herein enables the person skilled in the art to implement or use the present application. Various modifications to the embodiments will be apparent to the person skilled in the art, and the general principle herein can be implemented in other embodiments without departing from the spirit or scope of the present application. Therefore, the present application is not limited to the embodiments described herein, but should be in accordance with the widest scope consistent with the principle and novel features disclosed herein.

The invention claimed is:

1. A fixing device, comprising:

a structural member, wherein the structural member is a cylindrical structure, a first screw thread is provided on an outer peripheral surface of the cylindrical structure and the structural member is configured to match with a connector of an light emitting diode (LED) lamp fixture, a top of the structural member is open, and a through hole configured to allow a wire to pass through, and a threaded hole configured to install a heat dissipation member are provided at a bottom of the structural member;

a fixing ring, wherein the fixing ring is a ring-shaped structure, and an inner wall of the ring-shaped structure is provided with a second screw thread matching with the first screw thread, and the fixing ring is configured to be sleeved on an outer peripheral surface of the structural member, to screw the structural member into the connector of the LED lamp fixture;

a heat dissipation member, wherein the heat dissipation member is fixed inside the structural member, and is a cylindrical structure matching with an inner wall of the structural member, and is fixed to the structural member by a fastener, wherein the fastener for fixing the structural member and the heat dissipation member is inserted in the threaded hole; and a fixing plate, wherein the fixing plate matches with the bottom of the structural member, and is fixed to an outside of the structural member, and the fastener passes through the fixing plate, the structural member and the heat dissipation member in the listed sequence.

2. The fixing device according to claim 1, wherein two of the threaded holes are provided at the bottom of the structural member, and two of the fasteners are inserted in the two threaded holes respectively.

3. The fixing device according to claim 1, wherein the fastener is a screw.

4. The fixing device according to claim 2, wherein the through hole is provided at a central position of the bottom of the structural member.

5. The fixing device according to claim 4, wherein the two threaded holes are arranged symmetrically at two sides of the through hole.

6. The fixing device according to claim 1, wherein a material for making the structural member is plastic or ceramic.

7. The fixing device according to claim 1, wherein a material for making the heat dissipation member is metal.

8. An light emitting diode (LED) bulb, comprising the fixing device according to claim 1.

9. The LED bulb according to claim 8, further comprising:

a heat conduction member fixed inside the heat dissipation member;

a power supply arranged between the heat conduction member and the heat dissipation member;

a light source plate fixed at a top of the heat conduction member; and a light source fixed at a top of the light source plate.

10. The LED bulb according to claim 9, further comprising housing, wherein the housing is connected to the top of the structural member in a sealed manner.

11. The LED bulb according to claim 9, wherein the heat conduction member and the heat dissipation member are in an interference fit.

12. The LED bulb according to claim 10, wherein the housing and the structural member are sealed by adhesive bonding or mechanical connection.

13. The LED bulb according to claim 10, wherein a material for making the housing is a light-transmitting plastic or a light-transmitting glass.

* * * * *